US007994075B1

(12) United States Patent
Ardiff et al.

(10) Patent No.: US 7,994,075 B1
(45) Date of Patent: Aug. 9, 2011

(54) LOW WEIGHT AND HIGH DURABILITY SOFT BODY ARMOR COMPOSITE USING TOPICAL WAX COATINGS

(75) Inventors: Henry G. Ardiff, Chesterfield, VA (US); Brian D. Arvidson, Chester, VA (US)

(73) Assignee: Honeywell International, Inc., Morristown, NJ (US)

( * ) Notice: Subject to any disclaimer, the term of this patent is extended or adjusted under 35 U.S.C. 154(b) by 687 days.

(21) Appl. No.: 12/037,370

(22) Filed: Feb. 26, 2008

(51) Int. Cl.
*B32B 27/04* (2006.01)

(52) U.S. Cl. ..... 442/134; 2/2.5; 428/911; 442/135

(58) Field of Classification Search ..... 2/2.5; 428/911, 428/421, 474.4; 442/134, 135, 148, 168
See application file for complete search history.

(56) References Cited

U.S. PATENT DOCUMENTS

| | | | | |
|---|---|---|---|---|
| 5,229,199 | A * | 7/1993 | Miner et al. | 442/135 |
| 5,587,230 | A * | 12/1996 | Lin et al. | 442/135 |
| 5,635,279 | A | 6/1997 | Ma et al. | |
| 7,037,579 | B2 | 5/2006 | Hassan et al. | |
| 7,228,586 | B2 | 6/2007 | Prodoehl et al. | |
| 2006/0135022 | A1 | 6/2006 | Porter | 442/381 |

* cited by examiner

*Primary Examiner* — Arti Singh-Pandey

(57) ABSTRACT

Ballistic resistant articles having abrasion resistance. Particularly, abrasion resistant, ballistic resistant articles and composites having a wax-based topical treatment.

20 Claims, No Drawings

LOW WEIGHT AND HIGH DURABILITY SOFT BODY ARMOR COMPOSITE USING TOPICAL WAX COATINGS

BACKGROUND OF THE INVENTION

1. Field of the Invention

This invention relates to ballistic resistant articles having topical wax coatings.

2. Description of the Related Art

Ballistic resistant articles containing high strength fibers that have excellent properties against projectiles are well known. Articles such as bullet resistant vests, helmets, vehicle panels and structural members of military equipment are typically made from fabrics comprising high strength fibers. High strength fibers conventionally used include polyethylene fibers, aramid fibers such as poly(phenylenediamine terephthalamide), graphite fibers, nylon fibers, glass fibers and the like. For many applications, such as vests or parts of vests, the fibers may be used in a woven or knitted fabric. For other applications, the fibers may be encapsulated or embedded in a polymeric matrix material to form woven or non-woven rigid or flexible fabrics. Preferably each of the individual fibers forming the fabrics of the invention are substantially coated or encapsulated by the binder (matrix) material.

Various ballistic resistant constructions are known that are useful for the formation of hard or soft armor articles such as helmets, panels and vests. For example, U.S. Pat. Nos. 4,403,012, 4,457,985, 4,613,535, 4,623,574, 4,650,710, 4,737,402, 4,748,064, 5,552,208, 5,587,230, 6,642,159, 6,841,492, 6,846,758, all of which are incorporated herein by reference, describe ballistic resistant composites which include high strength fibers made from materials such as extended chain ultra-high molecular weight polyethylene. These composites display varying degrees of resistance to penetration by high speed impact from projectiles such as bullets, shells, shrapnel and the like.

For example, U.S. Pat. Nos. 4,623,574 and 4,748,064 disclose simple composite structures comprising high strength fibers embedded in an elastomeric matrix. U.S. Pat. No. 4,650,710 discloses a flexible article of manufacture comprising a plurality of flexible layers comprised of high strength, extended chain polyolefin (ECP) fibers. The fibers of the network are coated with a low modulus elastomeric material. U.S. Pat. Nos. 5,552,208 and 5,587,230 disclose an article and method for making an article comprising at least one network of high strength fibers and a matrix composition that includes a vinyl ester and diallyl phthalate. U.S. Pat. No. 6,642,159 discloses an impact resistant rigid composite having a plurality of fibrous layers which comprise a network of filaments disposed in a matrix, with elastomeric layers there between. The composite is bonded to a hard plate to increase protection against armor piercing projectiles.

Hard or rigid body armor provides good ballistic resistance, but can be very stiff and bulky. Accordingly, body armor garments, such as ballistic resistant vests, are preferably formed from flexible or soft armor materials. However, while such flexible or soft materials exhibit excellent ballistic resistance properties, they also generally exhibit unsatisfactory abrasion resistance, which affects durability of the armor. It is desirable in the art to provide soft, flexible ballistic resistant materials having improved abrasion resistance and durability. The present invention provides a solution to this need. More importantly, it has been unexpectedly found that the presence of a wax coating significantly improved the ballistic penetration resistance of the ballistic resistant composites described herein against projectiles such as 9 mm full metal jacket bullets and 44 Magnum bullets.

SUMMARY OF THE INVENTION

The invention provides a ballistic resistant composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a layer of a polymeric binder material on a surface of said one or more fibers, and a layer of a wax on the polymeric binder material layer.

The invention further provides a method of forming a ballistic resistant composite, comprising:

i) providing at least one coated fibrous substrate having a surface; wherein said at least one fibrous substrate comprises one or more fibers having a tenacity of about 7 g/denier or more and a tensile modulus of about 150 g/denier or more; the surfaces of each of said fibers being substantially coated with a polymeric binder material; and ii) applying a wax onto at least a portion of said at least one coated fibrous substrate.

DETAILED DESCRIPTION OF THE INVENTION

The invention presents abrasion resistant fibrous composites and articles having good durability and enhanced ballistic penetration resistance. Particularly, the invention provides fibrous composites formed by applying a multilayer coating of the invention onto at least one fibrous substrate. A "fibrous substrate" as used herein may be a single fiber or a fabric, including felt, that has been formed from a plurality of fibers. Preferably, the fibrous substrate is a fabric comprising a plurality of fibers that are united as a monolithic structure, including woven and non-woven fabrics. The coatings of the polymeric binder material or both the polymeric binder material and the wax may be applied onto a plurality of fibers that are arranged as a fiber web or other arrangement, which may or may not be considered to be a fabric at the time of coating. The invention also provides fabrics formed from a plurality of coated fibers, and articles formed from said fabrics.

The fibrous substrates of the invention are coated with a multilayer coating that comprises at least one layer of a polymeric binder material and at least one layer of a wax, where said layers are different. At least one layer of the polymeric binder material is applied directly onto a surface of one or more of the fibers and at least one topical coating of a wax is applied on top of the polymeric binder material layer. As discussed in more detail below, while the wax coating is "on top of" the polymeric binder layer, the two need not necessarily be in direct contact with one another.

Waxes are generally defined a materials that are solids at room temperature, but melt or soften without decomposing at temperatures above about 40° C. They are generally organic and insoluble in water at room temperature, but may be water wettable and may form pastes and gels in some solvents, such as non-polar organic solvents. Waxes may be branched or linear, may have high or low crystallinity and have relatively low polarity. Their molecular weights may range from about 400 to about 25,000 and have melting points ranging from about 40° C. to about 150° C. They generally do not form stand-alone films like higher order polymers and generally are aliphatic hydrocarbons that contain more carbon atoms than oils and greases. The viscosity of waxes may range from low to high, typically depending on the molecular weight of the wax and the crystallinity. The viscosity of waxes above their melting point is typically low, and it is preferred that the topical wax coating comprises a low viscosity wax. As used herein, a "low viscosity wax" describes a wax having a melt viscosity of less than or equal to about 500 centipoise (cps) at 140° C. Preferably, a low viscosity wax has a viscosity of less than about 250 cps at 140° C., most preferably less than about 100 cps at 140° C. However, some linear polyethylene waxes (molecular weight of about 2000 to about 10,000) and polypropylene waxes may have moderate to high viscosity, i.e. as high as 10,000 centipoise after melting. Viscosity values are measured using techniques that are well known in the art and may be measured, for example, using capillary, rotational or moving body rheometers. A preferred measurement tool is a Brookfield rotational viscometer. Preferred waxes have a weight average molecular weight of from about 400 to about 10,000. More preferably, the waxes are substantially linear polymers and have a weight average molecular weight of less than about 1500 and preferably a number average molecular weight of less than about 800.

Suitable waxes include both natural and synthetic waxes and non-exclusively include animal waxes, such as beeswax, Chinese wax, shellac wax, spermaceti and wool wax (lanolin); vegetable waxes, such as bayberry wax, candelilla wax, carnauba wax, castor wax, esparto wax, Japan wax, Jojoba oil wax, ouricury wax, rice bran wax and soy wax; mineral waxes, such as ceresin waxes, montan wax, ozocerite wax and peat waxes; petroleum waxes, such as paraffin wax and microcrystalline waxes; and synthetic waxes, including polyolefin waxes, including polyethylene and polypropylene waxes, Fischer-Tropsch waxes, stearamide waxes (including ethylene bis-stearamide waxes), polymerized α-olefin waxes, substituted amide waxes (e.g. esterified or saponified substituted amide waxes) and other chemically modified waxes. Also suitable are waxes described in U.S. Pat. No. 4,544,694, the disclosure of which is incorporated herein by reference. Of these, the preferred waxes include paraffin waxes, microcrystalline waxes, Fischer-Tropsch waxes, branched and linear polyethylene waxes, polypropylene waxes, carnauba waxes, ethylene bis-stearamide (EBS) waxes and combinations. Table 1 outlines the properties of these preferred waxes:

TABLE 1

| Wax | Molecular Weight (Mw) | Crystallinity | Density | Melting Point (° C.) | Penetration Hardness (dmm) | Typical Viscosity (cps) above melting pt. |
|---|---|---|---|---|---|---|
| Paraffin | ~400 | Low | 0.9 | 50-70 | 10-20 | Low |
| Micro-Crystalline | ~650 | Low | 0.96 | 60-90 | 5-30 | Low |
| Fischer-Tropsch | ~600 | Very High | 0.94 | 95-100 | 1-2 | Low |
| Branched Polyethylene | 1000-10,000 | Moderate | 0.91-0.94 | 90-140 | 1-100 | Low to Moderate |
| Linear Polyethylene | 1000-10,000 | Moderate to Very High | 0.93-0.97 | 90-140 | <0.5-5 | Low to High |
| Polypropylene | 2000-10,000 | Very High | 0.9 | 140-150 | <0.5 | Moderate to High |
| Carnauba | Mixture of low MW materials | High | 0.97 | 78-85 | 2-3 | Low |
| EBS | 593 | Medium to High | 0.97 | 135-146 | <5 | Low |

Another wax useful herein comprises a byproduct composition recovered during the polymerization of ethylene with a Ziegler-type catalyst, such as a Ziegler-Natta catalyst, via a process conventionally known in the art as the Ziegler slurry polymerization process. In general, the Ziegler slurry polymerization process is used to form high density polyethylene (HDPE) homopolymers or ethylene copolymers, such as ethylene-α-olefin copolymers. During polymerization, low molecular weight, wax-like fractions are solubilized in the diluent that is used during polymerization and may be recovered therefrom. Such a byproduct wax is generally a high density polyethylene wax, typically a polyethylene homopolymer wax that has a density of from about 0.92-0.96 g/cc. The byproduct wax is distinguished from other polyethylene waxes made by direct synthesis from ethylene or made by thermal degradation of high molecular weight polyethylene resins, each of which form polymers of both high and low densities. Such byproduct waxes are also generally not recovered from other processes such as gas phase polymerization processes or solution polymerization processes.

Also suitable for the wax layer are wax blends comprising waxes blended with other materials that are not considered waxes. Preferred wax blends include blends of wax with fluorine-containing polymers. Such suitable fluorine-containing polymers include polytetrafluoroethylene such as TEFLON® which is commercially available from E. I. duPont de Nemours and Company of Wilmington, Del. Preferred blends would include from about 5% to about 50% percent of the fluoropolymer by weight of the blend, more preferably from about 10% to about 30% of the fluoropolymer by weight of the blend. Preferred fluoropolymer/wax blends comprise organic waxes. Also preferred are wax blends comprising waxes blended with materials such as silica, alumina and/or mica, which may be used as processing aids. The processing aids may be incorporated into the blend at levels up to about 50% by weight of the blend, with a preferred range of from about 1% to about 25% by weight and a most preferably from about 2% to about 10% by weight.

Most preferably, the wax coating comprises one or more polyethylene homopolymer waxes, such as Shamrock S-379 and S-394 waxes, commercially available from Shamrock Technologies, Inc. of Newark, N.J. and A-C 6, A-C 7, A-C 8, A-C 9, A-C 617 and A-C 820 waxes, commercially available from Honeywell International Inc. of Morristown, N.J.; oxidized polyethylene homopolymer waxes, such as NEPTUNE™ 5223-N4 and NEPTUNE™ S-250 SD5, commercially available from Shamrock Technologies, Inc., and A-C 629 and A-C 673, commercially available from Honeywell International Inc.; ethylene bis-stearamide waxes, such as Shamrock S-400, commercially available from Shamrock Technologies, Inc., and Acrawax® C, commercially available from Lonza Group, Ltd. of, Basel, Switzerland; carnauba waxes, such as Grade #63 and Grade #200, commercially available from Strahl & Pitsch, Inc. of West Babylon, N.Y. and Shamrock S-232, commercially available from Shamrock Technologies, Inc.; paraffin waxes, such as Hydropel QB, commercially available from Shamrock Technologies, Inc., as well as blends and alloys containing any of these materials, such as FLUOROSLIP™ 731MG, which is a PE/PTFE blend, commercially available from Shamrock Technologies, Inc. The wax acts as a barrier to potential abradants and also may fill in voids between filaments of a fabric, thereby increasing the integrity of the fabric. The wax may also increase the hardness or toughness of the composite fabric surface, which would increase its durability. The wax may also serve as a lubricant, uniformly coating the substrate with a thin layer of the wax and enhancing abrasion resistance.

The coated fibrous substrates of the invention are particularly intended for the production of fabrics and articles having superior ballistic penetration resistance. For the purposes of the invention, articles that have superior ballistic penetration resistance describe those which exhibit excellent properties against deformable projectiles, such as bullets, and against penetration of fragments, such as shrapnel.

For the purposes of the present invention, a "fiber" is an elongate body the length dimension of which is much greater than the transverse dimensions of width and thickness. The cross-sections of fibers for use in this invention may vary widely. They may be circular, flat or oblong in cross-section. Accordingly, the term fiber includes filaments, ribbons, strips and the like having regular or irregular cross-section. They may also be of irregular or regular multi-lobal cross-section having one or more regular or irregular lobes projecting from the linear or longitudinal axis of the fibers. It is preferred that the fibers are single lobed and have a substantially circular cross-section.

As stated above, the multilayer coatings may be applied onto a single polymeric fiber or a plurality of polymeric fibers. A plurality of fibers may be present in the form of a fiber web (e.g. a parallel array or a felt), a woven fabric, a non-woven fabric or a yarn, where a yarn is defined herein as a strand consisting of multiple fibers and where a fabric comprises a plurality of united fibers. In embodiments including a plurality of fibers, the multilayer coatings may be applied either before the fibers are arranged into a fabric or yarn, or after the fibers are arranged into a fabric or yarn.

The fibers of the invention may comprise any polymeric fiber type. Most preferably, the fibers comprise high strength, high tensile modulus fibers which are useful for the formation of ballistic resistant materials and articles. As used herein, a "high-strength, high tensile modulus fiber" is one which has a preferred tenacity of at least about 7 g/denier or more, a preferred tensile modulus of at least about 150 g/denier or more, and preferably an energy-to-break of at least about 8 J/g or more, each both as measured by ASTM D2256. As used herein, the term "denier" refers to the unit of linear density, equal to the mass in grams per 9000 meters of fiber or yarn. As used herein, the term "tenacity" refers to the tensile stress expressed as force (grams) per unit linear density (denier) of an unstressed specimen. The "initial modulus" of a fiber is the property of a material representative of its resistance to deformation. The term "tensile modulus" refers to the ratio of the change in tenacity, expressed in grams-force per denier (g/d) to the change in strain, expressed as a fraction of the original fiber length (in/in).

The polymers forming the fibers are preferably high-strength, high tensile modulus fibers suitable for the manufacture of ballistic resistant fabrics. Particularly suitable high-strength, high tensile modulus fiber materials that are particularly suitable for the formation of ballistic resistant materials and articles include polyolefin fibers including high density and low density polyethylene. Particularly preferred are extended chain polyolefin fibers, such as highly oriented, high molecular weight polyethylene fibers, particularly ultra-high molecular weight polyethylene fibers, and polypropylene fibers, particularly ultra-high molecular weight polypropylene fibers. Also suitable are aramid fibers, particularly para-aramid fibers, polyamide fibers, polyethylene terephthalate fibers, polyethylene naphthalate fibers, extended chain polyvinyl alcohol fibers, extended chain polyacrylonitrile fibers, polybenzazole fibers, such as polybenzoxazole (PBO) and polybenzothiazole (PBT) fibers, liquid crystal copolyester fibers and rigid rod fibers such as M5® fibers. Each of these fiber types is conventionally known in the art. Also suitable for producing polymeric fibers are copolymers, block polymers and blends of the above materials.

The most preferred fiber types for ballistic resistant fabrics include polyethylene, particularly extended chain polyethylene fibers, aramid fibers, polybenzazole fibers, liquid crystal copolyester fibers, polypropylene fibers, particularly highly oriented extended chain polypropylene fibers, polyvinyl alcohol fibers, polyacrylonitrile fibers and rigid rod fibers, particularly M5® fibers.

In the case of polyethylene, preferred fibers are extended chain polyethylenes having molecular weights of at least 500,000, preferably at least one million and more preferably between two million and five million. Such extended chain polyethylene (ECPE) fibers may be grown in solution spinning processes such as described in U.S. Pat. No. 4,137,394 or 4,356,138, which are incorporated herein by reference, or may be spun from a solution to form a gel structure, such as described in U.S. Pat. Nos. 4,551,296 and 5,006,390, which are also incorporated herein by reference. A particularly preferred fiber type for use in the invention are polyethylene fibers sold under the trademark SPECTRA® from Honeywell International Inc. SPECTRA® fibers are well known in the art and are described, for example, in U.S. Pat. Nos. 4,623,547 and 4,748,064.

Also particularly preferred are aramid (aromatic polyamide) or para-aramid fibers. Such are commercially available and are described, for example, in U.S. Pat. No. 3,671,542. For example, useful poly(p-phenylene terephthalamide) filaments are produced commercially by DuPont under the trademark of KEVLAR®. Also useful in the practice of this invention are poly(m-phenylene isophthalamide) fibers produced commercially by DuPont under the trademark NOMEX® and fibers produced commercially by Teijin under the trademark TWARON®; aramid fibers produced commercially by Kolon Industries, Inc. of Korea under the trademark HERACRON®; p-aramid fibers SVM™ and RUSAR™ which are produced commercially by Kamensk Volokno JSC of Russia and ARMOS™ p-aramid fibers produced commercially by JSC Chim Volokno of Russia.

Suitable polybenzazole fibers for the practice of this invention are commercially available and are disclosed for example in U.S. Pat. Nos. 5,286,833, 5,296,185, 5,356,584, 5,534,205 and 6,040,050, each of which are incorporated herein by reference. Suitable liquid crystal copolyester fibers for the practice of this invention are commercially available and are disclosed, for example, in U.S. Pat. Nos. 3,975,487; 4,118,372 and 4,161,470, each of which is incorporated herein by reference.

Suitable polypropylene fibers include highly oriented extended chain polypropylene (ECPP) fibers as described in U.S. Pat. No. 4,413,110, which is incorporated herein by reference. Suitable polyvinyl alcohol (PV-OH) fibers are described, for example, in U.S. Pat. Nos. 4,440,711 and 4,599,267 which are incorporated herein by reference. Suitable polyacrylonitrile (PAN) fibers are disclosed, for example, in U.S. Pat. No. 4,535,027, which is incorporated herein by reference. Each of these fiber types is conventionally known and is widely commercially available.

The other suitable fiber types for use in the present invention include rigid rod fibers such as M5® fibers, and combinations of all the above materials, all of which are commercially available. For example, the fibrous layers may be formed from a combination of SPECTRA® fibers and Kevlar® fibers. M5® fibers are formed from pyridobisimidazole-2,6-diyl (2,5-dihydroxy-p-phenylene) and are manufactured by Magellan Systems International of Richmond, Va. and are described, for example, in U.S. Pat. Nos. 5,674,969, 5,939,553, 5,945,537, and 6,040,478, each of which is incorporated herein by reference. Specifically preferred fibers include M5® fibers, polyethylene SPECTRA® fibers, aramid Kevlar® fibers and aramid TWARON® fibers. The fibers may be of any suitable denier, such as, for example, 50 to about 3000 denier, more preferably from about 200 to 3000 denier, still more preferably from about 650 to about 2000 denier, and most preferably from about 800 to about 1500 denier. The selection is governed by considerations of ballistic effectiveness and cost. Finer fibers are more costly to manufacture and to weave, but can produce greater ballistic effectiveness per unit weight.

The most preferred fibers for the purposes of the invention are either high-strength, high tensile modulus extended chain polyethylene fibers or high-strength, high tensile modulus para-aramid fibers. As stated above, a high-strength, high tensile modulus fiber is one which has a preferred tenacity of about 7 g/denier or more, a preferred tensile modulus of about 150 g/denier or more and a preferred energy-to-break of about 8 J/g or more, each as measured by ASTM D2256. In the preferred embodiment of the invention, the tenacity of the fibers should be about 15 g/denier or more, preferably about 20 g/denier or more, more preferably about 25 g/denier or more and most preferably about 30 g/denier or more. The fibers of the invention also have a preferred tensile modulus of about 300 g/denier or more, more preferably about 400 g/denier or more, more preferably about 500 g/denier or more, more preferably about 1,000 g/denier or more and most preferably about 1,500 g/denier or more. The fibers of the invention also have a preferred energy-to-break of about 15 J/g or more, more preferably about 25 J/g or more, more preferably about 30 J/g or more and most preferably have an energy-to-break of about 40 J/g or more.

These combined high strength properties are obtainable by employing well known processes. U.S. Pat. Nos. 4,413,110, 4,440,711, 4,535,027, 4,457,985, 4,623,547 4,650,710 and 4,748,064 generally discuss the formation of preferred high strength, extended chain polyethylene fibers employed in the present invention. Such methods, including solution grown or gel fiber processes, are well known in the art. Methods of forming each of the other preferred fiber types, including para-aramid fibers, are also conventionally known in the art, and the fibers are commercially available.

The polymeric binder material layer, also known in the art as a polymeric matrix material, preferably comprises at least one material that is conventionally used in the art as a polymeric binder or matrix material, binding a plurality of fibers together by way of its inherent adhesive characteristics or after being subjected to well known heat and/or pressure conditions. Such include both low modulus, elastomeric materials and high modulus, rigid materials. Preferred low modulus, elastomeric materials are those having an initial tensile modulus less than about 6,000 psi (41.3 MPa) as measured at 37° C. by ASTM D638. Preferred high modulus, rigid materials generally have a higher initial tensile modulus. As used herein throughout, the term tensile modulus means the modulus of elasticity as measured by ASTM 2256 for a fiber and by ASTM D638 for a polymeric binder material. Generally, a polymeric binder coating is necessary to efficiently merge, i.e. consolidate, a plurality of non-woven fiber plies. The polymeric binder material may be applied onto the entire surface area of the individual fibers, or only onto a partial surface area of the fibers. Most preferably, the coating of the polymeric binder material is applied onto substantially all the surface area of each individual fiber forming a woven or non-woven fabric of the invention. Where the fabrics comprise a plurality of yarns, each fiber forming a single strand of yarn is preferably coated with the polymeric binder material.

An elastomeric polymeric binder material may comprise a variety of materials. A preferred elastomeric binder material comprises a low modulus elastomeric material. For the purposes of this invention, a low modulus elastomeric material has a tensile modulus, measured at about 6,000 psi (41.4 MPa) or less according to ASTM D638 testing procedures. Preferably, the tensile modulus of the elastomer is about 4,000 psi (27.6 MPa) or less, more preferably about 2400 psi (16.5 MPa) or less, more preferably 1200 psi (8.23 MPa) or less, and most preferably is about 500 psi (3.45 MPa) or less. The glass transition temperature (Tg) of the elastomer is preferably about 0° C. or less, more preferably about −40° C. or less, and most preferably about −50° C. or less. The elastomer also has a preferred elongation to break of at least about 50%, more preferably at least about 100% and most preferably has an elongation to break of at least about 300%.

A wide variety of materials and formulations having a low modulus may be utilized for the polymeric binder coating. Representative examples include polybutadiene, polyisoprene, natural rubber, ethylene-propylene copolymers, ethylene-propylene-diene terpolymers, polysulfide polymers, polyurethane elastomers, chlorosulfonated polyethylene, polychloroprene, plasticized polyvinylchloride, butadiene acrylonitrile elastomers, poly(isobutylene-co-isoprene), polyacrylates, polyesters, polyethers, copolymers of ethylene, and combinations thereof, and other low modulus polymers and copolymers. Also preferred are blends of different elastomeric materials, or blends of elastomeric materials with one or more thermoplastics.

Particularly useful are block copolymers of conjugated dienes and vinyl aromatic monomers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type A-B-A, multi-block copolymers of the type $(AB)_n$ (n=2-10) or radial configuration copolymers of the type $R-(BA)_x$ (x=3-150); wherein A is a block from a polyvinyl aromatic monomer and B is a block from a conjugated diene elastomer. Many of these polymers are produced commercially by Kraton Polymers of Houston, Tex. and described in the bulletin "Kraton Thermoplastic Rubber", SC-68-81. The most preferred low modulus polymeric binder materials comprise styrenic block copolymers, particularly polystyrene-polyisoprene-polystrene-block copolymers, sold under the trademark KRATON® commercially produced by Kraton Polymers and HYCAR® acrylic polymers commercially available from Noveon, Inc. of Cleveland, Ohio.

Preferred high modulus, rigid polymers useful for the polymeric binder material include polymers such as a vinyl ester polymer or a styrene-butadiene block copolymer, and also mixtures of polymers such as vinyl ester and diallyl phthalate or phenol formaldehyde and polyvinyl butyral. A particularly preferred high modulus material is a thermosetting polymer, preferably soluble in carbon-carbon saturated solvents such as methyl ethyl ketone, and possessing a high tensile modulus when cured of at least about $1\times10^5$ psi (689.5 MPa) as measured by ASTM D638. Particularly preferred rigid materials are those described in U.S. Pat. No. 6,642,159, which is incorporated herein by reference.

In the preferred embodiments of the invention, the polymeric binder material layer comprises a polyurethane polymer, a polyether polymer, a polyester polymer, a polycarbonate polymer, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene/butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy polymer, a novolac polymer, a phenolic polymer, a vinyl ester polymer, a nitrile rubber polymer, a natural rubber polymer, a cellulose acetate butyrate polymer, a polyvinyl butyral polymer, an acrylic polymer, an acrylic copolymer or an acrylic copolymer incorporating non-acrylic monomers.

Also useful herein are fluorine-containing polymeric binder materials as well as blends of non-fluorine-containing polymers with fluorine-containing polymers. As used herein, a "fluorine-containing" polymer includes fluoropolymers and fluorocarbon-containing materials (i.e. fluorocarbon resins). A "fluorocarbon resin" generally refers to polymers including fluorocarbon groups. Useful fluoropolymer and fluorocarbon resin materials herein include fluoropolymer homopolymers, fluoropolymer copolymers or blends thereof as are well known in the art and are described in, for example, U.S. Pat. Nos. 4,510,301, 4,544,721 and 5,139,878. Also preferred are fluorocarbon-modified polymers, particularly fluoro-oligomers and fluoropolymers formed by grafting fluorocarbon side-chains onto conventional polyethers (i.e. fluorocarbon-modified polyethers), polyesters (i.e. fluorocarbon-modified polyesters), polyanions (i.e. fluorocarbon-modified polyanions) such as polyacrylic acid (i.e. fluorocarbon-modified polyacrylic acid) or polyacrylates (i.e. fluorocarbon-modified polyacrylates), and polyurethanes (i.e. fluorocarbon-modified polyurethanes). These fluorocarbon side chains or perfluoro compounds are generally produced by a telomerization process and are generally referred to as $C_8$ fluorocarbons. For example, a fluoropolymer or fluorocarbon resin may be derived from the telomerization of an unsaturated fluorocompound, forming a fluorotelomer, where said fluorotelomer is further modified to allow reaction with a polyether, polyester, polyanion, polyacrylic acid, polyacrylate or polyurethane, and where the fluorotelomer is then grafted onto a polyether, polyester, polyanion, polyacrylic acid, polyacrylate or polyurethane. Good representative examples of these fluorocarbon-containing polymers are NUVA® fluoropolymer products, commercially available from Clariant International, Ltd. of Switzerland. Other fluorocarbon resins, fluoro-oligomers and fluoropolymers having perfluoro acid-based and perfluoro alcohol-based side chains are also most preferred. Fluoropolymers and fluorocarbon resins having fluorocarbon side chains of shorter lengths, such as $C_6$, $C_4$ or $C_2$, are also suitable, such as PolyFox™ fluorochemicals, commercially available from Omnova Solutions, Inc. of Fairlawn, Ohio.

The rigidity, impact and ballistic properties of the articles formed from the fibrous composites of the invention are affected by the tensile modulus of the binder polymers coating the fibers. For example, U.S. Pat. No. 4,623,574 discloses that fiber reinforced composites constructed with elastomeric matrices having tensile moduli less than about 6000 psi (41,300 kPa) have superior ballistic properties compared both to composites constructed with higher modulus polymers, and also compared to the same fiber structure without one or more coatings of a polymeric binder material. However, low tensile modulus polymeric binder polymers also yield lower rigidity composites. Further, in certain applications, particularly those where a composite must function in both anti-ballistic and structural modes, there is needed a superior combination of ballistic resistance and rigidity. Accordingly, the most appropriate type of polymeric binder material to be used will vary depending on the type of article to be formed from the fabrics of the invention. In order to achieve a compromise in both properties, a suitable polymeric binder material may also comprise a combination of both low modulus and high modulus materials. Each polymer or wax layer may also include fillers such as carbon black or silica, processing aids, may be extended with oils, or may be vulcanized by sulfur, peroxide, metal oxide or radiation cure systems if appropriate, as is well known in the art.

To produce a fabric article having sufficient ballistic resistance properties, the proportion of fibers forming the fabric preferably comprises from about 50% to about 98% by weight of the fibers plus the weight of the combined coatings, more preferably from about 70% to about 95%, and most preferably from about 78% to about 90% by weight of the fibers plus the coatings. Thus, the total weight of the combined coatings preferably comprises from about 1% to about 50% by weight, more preferably from about 2% to about 30%, more preferably from about 10% to about 22% and most preferably from about 14% to about 17% by weight of the fibers plus the weight of the combined coatings, wherein 16% is most preferred for non-woven fabrics. A lower binder/matrix content is appropriate for woven fabrics, wherein a binder content of greater than zero but less than 10% by weight of the fibers plus the weight of the combined coatings is most preferred. The weight of the topical wax coating is preferably from about 0.01% to about 7.0% by weight, more preferably from about 0.1% to about 3.0% and most preferably from about 0.2% to about 2.0% by weight of the fibers plus the weight of the combined coatings. These ranges would include the coatings of both sides of a fabric substrate, where it is preferable that each surface would have an equivalent coating weight. The corresponding thickness of the wax coatings that achieve these desired coating weights will vary. Different waxes have different densities which would result in different thicknesses for the same coating weight, and different fabrics may have unique surfaces that might require higher or lower coating weights to achieve optimal performance.

When forming non-woven fabrics, the polymeric binder coating is applied to a plurality of fibers arranged as a fiber web (e.g. a parallel array or a felt) or other arrangement, where the fibers are thereby coated on, impregnated with, embedded in, or otherwise applied with the coating. The fibers are preferably arranged into one or more fiber plies and the plies are then consolidated following conventional techniques. In another technique, fibers are coated, randomly arranged and consolidated forming a felt. When forming woven fabrics, the fibers may be coated with the polymeric binder coating either prior to or after weaving, preferably after. Such techniques are well known in the art. Articles of the invention may also comprise combinations of woven fabrics, non-woven fabrics formed from unidirectional fiber plies and non-woven felt fabrics.

Thereafter, the topical coating of the wax is applied onto at least one surface of the consolidated fabric (or other fibrous substrate) on top of the polymeric binder material layer. Accordingly, the fibrous substrates of the invention are coated with multilayer coatings comprising at least one layer of a polymeric binder material on a surface of said one or more fibers, and at least one layer of a wax on top of the polymeric binder material layer. Preferably, both outer surfaces of the fabric are coated with the wax to improve overall fabric durability, but coating just one outer surface of the fabric with the wax will also provide improved abrasion resistance, especially if care is taken to maintain the correct orientation of the fabric plies in the final article, and add less weight. To further maintain a low weight composite, preferred embodiments preferably include only one layer of the polymeric binder material and one layer of the wax. However, multiple polymeric binder material layers and/or multiple wax layers may be applied to a fibrous substrate. When additional layers or coatings are present, such materials may be positioned on (or between) either (or any) of the polymer binder coating(s) and/or wax coating(s). When additional binder and/or wax coatings are present, each wax layer may be the same as or different than other wax layer and each polymeric binder layer may be the same as or different than other polymeric binder layers. For example, a layer of a paraffin wax may be applied atop a layer of a polyethylene homopolymer wax.

In another embodiment, a tie-layer may be applied between the polymeric binder and the topical wax coating. Thus, while the wax coating is "on top of" the polymeric binder layer, the two need not necessarily be in direct contact with one another. Suitable tie-layers non-exclusively include thermoplastic polymer layers such as layers formed from polyolefins, polyamides, polyesters, polyurethanes, vinyl polymers, fluoropolymers and co-polymers and mixtures thereof. In another alternate embodiment, a coating of a high-friction material e.g. a silica powder may be applied on top of the polymeric binder, followed by a topical wax coating. Further, one or more layers of other organic or inorganic materials may be applied on top of the polymeric binder, followed by a topical wax coating. Useful inorganic materials non-exclusively include a ceramic, glass, a metal-filled composite, a ceramic-filled composite, a glass-filled composite, a cermet (composite of ceramic and metallic materials), high hardness steel, armor aluminum alloy, titanium or a combination thereof. In yet another alternate embodiment, ballistic resistant composites may include a first coating of a polymeric binder material on the fiber(s), then a topical wax coating on the binder coating, followed by a final topical coating of a silicone-based material on the wax. Accordingly, many different variations are possible, where binder/wax/silicone, binder/abrasive/wax, binder/tie layer/wax, and binder/wax blended with processing aid, are preferred variations. Nevertheless, it remains most preferred that the outermost layer on one or more outer surfaces of a fibrous substrate is a wax layer. The multilayer coating is preferably applied on top of any pre-existing fiber finish, such as a spin finish, or a pre-existing fiber finish may be at least partially removed prior to applying the coatings. The wax need only be on one or both exterior surfaces of the composite fabric, and the individual fibers need not be coated therewith.

For the purposes of the present invention, the term "coated" is not intended to limit the method by which the polymer layers are applied onto the fibrous substrate surface. Any appropriate application method may be utilized where the polymeric binder material layer is applied first directly onto the fiber surfaces, followed by subsequently applying the wax layer onto the polymeric binder material layer.

For example, the polymeric binder layer may be applied in solution form by spraying or roll coating a solution of the polymeric material onto fiber surfaces, wherein a portion of the solution comprises the desired polymer or polymers and a portion of the solution comprises a solvent capable of dissolving the polymer or polymers, followed by drying. Another method is to apply a neat polymer of the polymeric binder material(s) to the fibers either as a liquid, a sticky solid or particles in suspension or as a fluidized bed. Alternatively, the polymeric binder material may be applied as a solution, emulsion or dispersion in a suitable solvent which does not adversely affect the properties of fibers at the temperature of application. For example, fibers may be transported through a solution of the polymeric binder material and substantially coated with a polymeric binder material and then dried to form a coated fibrous substrate. The resulting coated fibers are then arranged into the desired configuration and thereafter coated with the wax. In another coating technique, unidirectional fiber plies or woven fabrics may first be arranged, followed by dipping the plies or fabrics into a bath of a solution containing the polymeric binder material dissolved in a suitable solvent, such that each individual fiber is at least partially coated with the polymer, and then dried through evaporation or volatilization of the solvent, and subsequently the wax may be applied via the same method. The dipping procedure may be repeated several times as required to place a desired amount of each polymeric coating onto the fibers, preferably substantially coating or encapsulating each of the individual fibers and covering all or substantially all of the fiber surface area with the polymeric binder material.

Other techniques for applying the polymeric binder coating to the fibers may be used, including coating of the high modulus precursor (gel fiber) before the fibers are subjected to a high temperature stretching operation, either before or after removal of the solvent from the fiber (if using a gel-spinning fiber forming technique). The fiber may then be stretched at elevated temperatures to produce the coated fibers. The gel fiber may be passed through a solution of the appropriate coating polymer under conditions to attain the desired coating. Crystallization of the high molecular weight polymer in the gel fiber may or may not have taken place before the fiber passes into the solution. Alternatively, the fibers may be extruded into a fluidized bed of an appropriate polymeric powder. Furthermore, if a stretching operation or other manipulative process, e.g. solvent exchanging, drying or the like is conducted, the polymeric binder material may be applied to a precursor material of the final fibers.

The binder coated fibers may be formed into non-woven fabrics which comprise a plurality of overlapping, non-woven fibrous plies that are consolidated into a single-layer, monolithic element. Most preferably, each ply comprises an arrangement of non-overlapping fibers that are aligned in a unidirectional, substantially parallel array. This type of fiber arrangement is known in the art as a "unitape" (unidirectional tape) and is referred to herein as a "single ply". As used herein, an "array" describes an orderly arrangement of fibers or yarns, and a "parallel array" describes an orderly parallel arrangement of fibers or yarns. A fiber "layer" describes a planar arrangement of woven or non-woven fibers or yarns including one or more plies. As used herein, a "single-layer" structure refers to monolithic structure composed of one or more individual fiber plies that have been consolidated into a single unitary structure. By "consolidating" it is meant that the polymeric binder coating together with each fiber ply are combined into a single unitary layer. Consolidation can occur via drying, cooling, heating, pressure or a combination thereof. Heat and/or pressure may not be necessary, as the fibers or fabric layers may just be glued together, as is the case in a wet lamination process. The term "composite" refers to combinations of fibers with the one or both of the coatings and an abrasion resistant composite will include the wax coating. Such is conventionally known in the art.

A preferred non-woven fabric of the invention includes a plurality of stacked, overlapping fiber plies (plurality of unitapes) wherein the parallel fibers of each single ply (unitape) are positioned orthogonally)(0°/90° to the parallel fibers of each adjacent single ply relative to the longitudinal fiber direction of each single ply. The stack of overlapping non-woven fiber plies is consolidated under heat and pressure, or by adhering the coatings of individual fiber plies, to form a single-layer, monolithic element which has also been referred to in the art as a single-layer, consolidated network where a "consolidated network" describes a consolidated (merged) combination of fiber plies with a polymeric binder/matrix. The terms "polymeric binder" and "polymeric matrix" are used interchangeably herein, and describe a material that binds fibers together. These terms are conventionally known in the art. For the purposes of this invention, where the fibrous substrate is a non-woven, consolidated fabric formed as a single-layer, consolidated network, the fibers are preferably substantially coated with the polymeric binder coating but only the outside surface of the monolithic fabric structure is coated with the wax coating to provide the desired, not each of the component fiber plies.

As is conventionally known in the art, excellent ballistic resistance is achieved when individual fiber plies are cross-plied such that the fiber alignment direction of one ply is rotated at an angle with respect to the fiber alignment direction of another ply. Most preferably, the fiber plies are cross-plied orthogonally at 0° and 90° angles, but adjacent plies can be aligned at virtually any angle between about 0° and about 90° with respect to the longitudinal fiber direction of another ply. For example, a five ply non-woven structure may have plies oriented at a 0°/45°/90°/45°/0° or at other angles. Such rotated unidirectional alignments are described, for example, in U.S. Pat. Nos. 4,457,985; 4,748,064; 4,916,000; 4,403,012; 4,623,573; and 4,737,402.

Most typically, non-woven fabrics include from 1 to about 6 plies, but may include as many as about 10 to about 20 plies as may be desired for various applications. The greater the number of plies translates into greater ballistic resistance, but also greater weight. Accordingly, the number of fiber plies forming a fabric or an article of the invention varies depending upon the ultimate use of the fabric or article. For example, in body armor vests for military applications, in order to form an article composite that achieves a desired 1.0 pound per square foot areal density (4.9 kg/m$^2$), a total of about 20 plies (or layers) to about 60 individual plies (or layers) may be required, wherein the plies/layers may be woven, knitted, felted or non-woven fabrics (with parallel oriented fibers or other arrangements) formed from the high-strength fibers described herein. In another embodiment, body armor vests for law enforcement use may have a number of plies/layers based on the National Institute of Justice (NIJ) Threat Level. For example, for an NIJ Threat Level 111A vest, there may be a total of 22 plies/layers. For a lower NIJ Threat Level, fewer plies/layers may be employed.

Consolidated non-woven fabrics may be constructed using well known methods, such as by the methods described in U.S. Pat. No. 6,642,159, the disclosure of which is incorporated herein by reference. As is well known in the art, consolidation is done by positioning the individual fiber plies on one another under conditions of sufficient heat and pressure to cause the plies to combine into a unitary fabric. Consolidation may be done at temperatures ranging from about 50° C. to about 175° C., preferably from about 105° C. to about 175° C., and at pressures ranging from about 5 psig (0.034 MPa) to about 2500 psig (17 MPa), for from about 0.01 seconds to about 24 hours, preferably from about 0.02 seconds to about 2 hours. When heating, it is possible that the polymeric binder coatings can be caused to stick or flow without completely melting. However, generally, if the polymeric binder materials are caused to melt, relatively little pressure is required to form the composite, while if the binder materials are only heated to a sticking point, more pressure is typically required. As is conventionally known in the art, consolidation may be conducted in a calender set, a flat-bed laminator, a press or in an autoclave.

Alternately, consolidation may be achieved by molding under heat and pressure in a suitable molding apparatus. Generally, molding is conducted at a pressure of from about 50 psi (344.7 kPa) to about 5000 psi (34470 kPa), more preferably about 100 psi (689.5 kPa) to about 1500 psi (10340 kPa), most preferably from about 150 psi (1034 kPa) to about 1000 psi (6895 kPa). Molding may alternately be conducted at higher pressures of from about 500 psi (3447 kPa) to about 5000 psi, more preferably from about 750 psi (5171 kPa) to about 5000 psi and more preferably from about 1000 psi to about 5000 psi. The molding step may take from about 4 seconds to about 45 minutes. Preferred molding temperatures range from about 200° F. (~93° C.) to about 350° F. (~177° C.), more preferably at a temperature from about 200° F. to about 300° F. (~149° C.) and most preferably at a temperature from about 200° F. to about 280° F. (~121° C.). The pressure under which the fabrics of the invention are molded has a direct effect on the stiffness or flexibility of the resulting molded product. Particularly, the higher the pressure at which the fabrics are molded, the higher the stiffness, and vice-versa. In addition to the molding pressure, the quantity, thickness and composition of the fabric plies and polymeric binder coating types also directly affects the stiffness of the articles formed from the inventive fabrics. Most commonly, a plurality of orthogonal fiber webs are "glued" together with the matrix polymer and run through a flat bed laminator to improve the uniformity and strength of the bond.

While each of the molding and consolidation techniques described herein are similar, each process is different. Particularly, molding is a batch process and consolidation is a continuous process. Further, molding typically involves the use of a mold, such as a shaped mold or a match-die mold when forming a flat panel, and does not necessarily result in a planar product. Normally consolidation is done in a flat-bed laminator, a calendar nip set or as a wet lamination to produce soft (flexible) body armor fabrics. Molding is typically reserved for the manufacture of hard armor, e.g. rigid plates. In the context of the present invention, consolidation techniques and the formation of soft body armor are preferred.

In either process, suitable temperatures, pressures and times are generally dependent on the type of polymeric binder coating materials, polymeric binder content (of the combined coatings), process used and fiber type. The fabrics of the invention may optionally be calendered under heat and pressure to smooth or polish their surfaces. Calendering methods are well known in the art.

Woven fabrics may be formed using techniques that are well known in the art using any fabric weave, such as plain weave, crowfoot weave, basket weave, satin weave, twill weave and the like. Plain weave is most common, where fibers are woven together in an orthogonal 0°/90° orientation. Prior to weaving, the individual fibers of each woven fabric material may or may not be coated with the polymeric binder material layer. The wax layer is most preferably coated onto the woven fabric. In another embodiment, a hybrid structure may be assembled where both woven and non-woven fabrics are combined and interconnected, such as by consolidation, in which case the wax layer is most preferably coated onto the exterior surfaces of the hybrid structure.

After coating the fibrous substrate or substrates with the polymeric binder material, the substrates are then coated with wax. In the typical embodiments of the invention, the fibrous substrate is a woven or non-woven fabric. In the case of a multi-ply, non-woven fabric, the wax is applied to the fabric surface or surfaces after consolidation of the multiple plies. The wax may be applied such that it covers all or substantially all of the polymeric binder material coating on the fibers. Most preferably, the topical coating of the wax is only partially applied onto the coated fibers or coated fabric, i.e. it is only necessary to coat the outside surfaces of the fabric.

The wax is applied to the fibrous substrate atop the polymeric binder material. This may be done, for example, via manually or automated powder coating, powder spraying or scatter coating techniques. When coating manually, a dry powdered (neat) wax is manually applied onto one or both surfaces of a fibrous substrate sample. The sample is then run through a flat-bed laminator at a temperature sufficient to press/melt/fuse the wax into/onto the surfaces of the composite fabric. Suitable temperatures will vary and will generally range from ambient conditions up to temperatures just below the decomposition temperature of the materials. In the automated technique, the substrate is preferably coated with a wax powder by a powder coater or scatter coater at the entrance to a flat-bed laminator. The coater may be calibrated with each specific wax to deliver a known amount of wax per unit area of the composite fabric, based on the wax drop rate and the linear velocity of the composite fabric, allowing for a targeted weight pick-up of wax by the composite fabric. The substrate is then fed into the flat-bed laminator as above. Optionally, the newly applied wax may be buffed on the surface of the composite fabric with a buffing roller before entering the flat-bed laminator. The wax may also be applied in solid, non-powder form or from a solution or dispersion, or by any other useful means that would be readily determined by one skilled in the art.

The thickness of the individual fabrics will correspond to the thickness of the individual fibers. A preferred woven fabric will have a preferred thickness of from about 25 μm to about 500 μm per layer, more preferably from about 50 μm to about 385 μm and most preferably from about 75 μm to about 255 μm per layer. A preferred non-woven fabric, i.e. a non-woven, single-layer, consolidated network, will have a preferred thickness of from about 12 μm to about 500 μm, more preferably from about 50 μm to about 385 μm and most preferably from about 75 μm to about 255 μm, wherein a single-layer, consolidated network typically includes two consolidated plies (i.e. two unitapes). The thickness of the topical wax coating will vary depending on the type of wax and desired coating weight, but a most preferred range would be about 0.5 μm to about 5 μm (per fabric surface), but this range is not intended to be limiting. While such thicknesses are preferred, it is to be understood that other thicknesses may be produced to satisfy a particular need and yet fall within the scope of the present invention.

The fabrics of the invention will have a preferred areal density of from about 50 grams/$m^2$ (gsm) (0.01 lb/$ft^2$ (psf)) to about 1000 gsm (0.2 psf). More preferable areal densities for the fabrics of this invention will range from about 70 gsm (0.014 psf) to about 500 gsm (0.1 psf). The most preferred areal density for fabrics of this invention will range from about 100 gsm (0.02 psf) to about 250 gsm (0.05 psf). The articles of the invention, which comprise multiple individual layers of fabric stacked one upon the other, will further have a preferred areal density of from about 1000 gsm (0.2 psf) to about 40,000 gsm (8.0 psf), more preferably from about 2000 gsm (0.40 psf) to about 30,000 gsm (6.0 psf), more preferably from about 3000 gsm (0.60 psf) to about 20,000 gsm (4.0 psf), and most preferably from about 3750 gsm (0.75 psf) to about 10,000 gsm (2.0 psf).

The composites of the invention may be used in various applications to form a variety of different ballistic resistant articles using well known techniques. For example, suitable techniques for forming ballistic resistant articles are described in, for example, U.S. Pat. Nos. 4,623,574, 4,650,710, 4,748,064, 5,552,208, 5,587,230, 6,642,159, 6,841,492 and 6,846,758. The composites are particularly useful for the formation of flexible, soft armor articles, including garments such as vests, pants, hats, or other articles of clothing, and covers or blankets, used by military personnel to defeat a number of ballistic threats, such as 9 mm full metal jacket (FMJ) bullets and a variety of fragments generated due to explosion of hand-grenades, artillery shells, Improvised Explosive Devices (IED) and other such devises encountered in a military and peace keeping missions.

As used herein, "soft" or "flexible" armor is armor that does not retain its shape when subjected to a significant amount of stress. The structures are also useful for the formation of rigid, hard armor articles. By "hard" armor is meant an article, such as helmets, panels for military vehicles, or protective shields, which have sufficient mechanical strength so that it maintains structural rigidity when subjected to a significant amount of stress and is capable of being freestanding without collapsing. The structures can be cut into a plurality of discrete sheets and stacked for formation into an article or they can be formed into a precursor which is subsequently used to form an article. Such techniques are well known in the art.

Garments of the invention may be formed through methods conventionally known in the art. Preferably, a garment may be formed by adjoining the ballistic resistant articles of the invention with an article of clothing. For example, a vest may comprise a generic fabric vest that is adjoined with the ballistic resistant structures of the invention, whereby the inventive structures are inserted into strategically placed pockets. This allows for the maximization of ballistic protection, while minimizing the weight of the vest. As used herein, the terms "adjoining" or "adjoined" are intended to include attaching, such as by sewing or adhering and the like, as well as unattached coupling or juxtaposition with another fabric, such that the ballistic resistant articles may optionally be easily removable from the vest or other article of clothing. Articles used in forming flexible structures like flexible sheets, vests and other garments are preferably formed from using a low tensile modulus binder material. Hard articles like helmets and armor are preferably, but not exclusively, formed using a high tensile modulus binder material.

Ballistic resistance properties are determined using standard testing procedures that are well known in the art. Particularly, the protective power or penetration resistance of a ballistic resistant composite is normally expressed by citing the impacting velocity at which 50% of the projectiles penetrate the composite while 50% are stopped by the composite, also known as the $V_{50}$ value. As used herein, the "penetration resistance" of an article is the resistance to penetration by a designated threat, such as physical objects including bullets, fragments, shrapnel and the like. For composites of equal areal density, which is the weight of the composite divided by its area, the higher the $V_{50}$, the better the ballistic resistance of the composite. The ballistic resistant properties of the articles of the invention will vary depending on many factors, particularly the type of fibers used to manufacture the fabrics, the percent by weight of the fibers in the composite, the suitability of the physical properties of the coating materials, the number of layers of fabric making up the composite and the total areal density of the composite.

Most importantly, it has been unexpectedly found that the presence of a wax coating significantly improved the ballistic penetration resistance of the ballistic resistant composites described herein against high energy projectiles. As illustrated in the examples below, it has been very unexpectedly found that the presence of a wax coating raised the 9 mm bullet $V_{50}$ of the various composites, on average, by approximately 80 ft/second (24 msec) and raised the 44 Magnum $V_{50}$ of the various composites, on average, by approximately 74 ft/second (23 m/sec). Thus the materials of the invention desirably achieve both enhanced abrasion resistance and improved ballistic penetration resistance.

The following examples serve to illustrate the invention:

EXAMPLES 1-16

Various fabric samples were tested for abrasion resistance as exemplified below. Each sample comprised 1000-denier TWARON® type 2000 aramid fibers which were coated with a polymeric binder material. For Samples A1-A8, the binder material was a fluorocarbon-modified, water-based acrylic polymer (84.5 wt. % acrylic copolymer sold as HYCAR® 26-1199, commercially available from Noveon, Inc. of Cleveland, Ohio; 15 wt. % NUVA® NT X490 fluorocarbon resin, commercially available from Clariant International, Ltd. of Switzerland; and 0.5% Dow TERGITOL® TMN-3 non-ionic surfactant commercially available from Dow Chemical Company of Midland, Mich.). For Samples B1-B8, the binder material was a fluoropolymer/nitrile rubber blend (84.5 wt. % nitrile rubber polymer sold as TYLAC®68073 from Dow Reichhold of North Carolina; 15 wt. % NUVA® TTH U fluorocarbon resin; and 0.5% Dow TERGITOL® TMN-3 non-ionic surfactant).

Each of the fabric samples were non-woven, consolidated fabrics with a two-ply (two unitape), 0°/90° construction. The fabrics had a fiber areal weight and Total Areal Density (TAD) (areal density of fabrics including the fibers and the polymeric binder material) that were equal for each sample. The fiber content of each fabric was approximately 85%, with the balance of 15% being the identified non-wax-containing polymeric binder material. Each of the wax coated samples A2-A8 and B2-B8, were coated with the following waxes, Samples A2 and B2 were coated on both sides with Shamrock FLUOROSLIP™ 731MG, which is a blend of polyethylene wax, carnauba wax and polytetrafluoroethylene, commercially available from Shamrock Technologies, Inc. Samples A3 and B3 were coated on both sides with Shamrock Hydropel QB, which is an alloy of paraffin wax and a synthetic wax, commercially available from Shamrock Technologies, Inc. Samples A4 and B4 were coated on both sides with Shamrock S-400 N5, which is an ethylene bis-stearamide wax, commercially available from Shamrock Technologies, Inc. Samples A5 and B5 were coated on both sides with Shamrock Neptune 5031, which is an oxidized polytetrafluoroethylene-based wax, commercially available from Shamrock Technologies, Inc. Samples A6 and B6 were coated on both sides with Shamrock S-232 N1, which is a blend of polyethylene wax and carnauba wax, commercially available from Shamrock Technologies, Inc. Samples A7 and B7 were coated on both sides with Shamrock SST-4MG polytetrafluoroethylene, commercially available from Shamrock Technologies, Inc. Samples A8 and B8 were coated with Shamrock SST-2 polytetrafluoroethylene, commercially available from Shamrock Technologies, Inc. Each wax-coated sample consisted of approximately 2 wt % of the wax and 98 wt. % of the composite fabric, by weight of the fabric plus the matrix/binder and the wax. Each of these wax-coated samples was coated by manually sprinkling an excess of the wax onto both surfaces of the sample, buffing the wax around the surfaces of the layer and removing the excess wax that did not adhere to the surfaces of the layer. Next, each of Samples A2 through A8 and B2 through B8 were processed by passing through a flat-bed laminator set at 220° F. (104.44° C.) to press/melt/fuse the wax into/onto the surfaces of the layer Each of the sixteen samples A1 through A8 and B1 through B8 described above were tested for abrasion resistance per a modified Inflated Diaphragm testing method of ASTM D3886. The modifications to the standard test ASTM D3886 method consisted of setting the top load to 5 lbs, the diaphragm pressure to 4 psi and running 2000 cycles for evaluation. Samples A1 and B1 were considered controls that were not coated with wax on their surfaces. The results are quantified as "Pass" or "Fail" based on the requirement of no broken surface characteristics after 2000 cycles (with a top load weight of 5 lbs and 4 psi diaphragm pressure). Both the sample and the abradant were identical for each example. Table 2 summarizes the results.

TABLE 2

Abrasion Resistance
Modified* ASTM D3886 - Inflated Diaphragm Method

| Example | Sample | Wax Coating | Result |
|---|---|---|---|
| 1 | A1 | None | Fail |
| 2 | A2 | FLUOROSLIP ™ 731 MG | Pass |
| 3 | A3 | Hydropel QB | Pass |
| 4 | A4 | S-400 N5 | Pass |
| 5 | A5 | Neptune 5031 | Pass |
| 6 | A6 | S-232 N1 | Pass |
| 7 | A7 | SST-4 MG | Pass |
| 8 | A8 | SST-2 | Pass |
| 9 | B1 | None | Fail |
| 10 | B2 | FLUOROSLIP ™ 731 MG | Pass |
| 11 | B3 | Hydropel QB | Pass |
| 12 | B4 | S-400 N5 | Pass |
| 13 | B5 | Neptune 5031 | Pass |
| 14 | B6 | S-232 N1 | Pass |
| 15 | B7 | SST-4 MG | Pass |
| 16 | B8 | SST-2 | Pass |

*Modified by: the top load weight (on the abradant) was set at 5 lb. (2.27 kg) and the number of cycles was set to 2000

This data illustrates that the application of a topical wax coating onto the surfaces of a composite fabric greatly improves the abrasion resistance and durability of the composite fabric.

EXAMPLES 17-33

Various fabric samples were tested for ballistic performance as exemplified below. Each sample comprised 1000-denier TWARON® type 2000 aramid fibers which were coated with a polymeric binder material, and included forty-five 15"×15" (38.1 cm×38.1 cm) fiber layers. For Samples C1-C5, the binder material was an unmodified, water-based polyurethane polymer. For Samples D1-D5, the binder material was a fluorocarbon-modified, water-based acrylic polymer (84.5 wt. % acrylic copolymer sold as HYCAR® 26-1199, commercially available from Noveon, Inc. of Cleveland, Ohio; 15 wt. % NUVA® NT X490 fluorocarbon resin, commercially available from Clariant International, Ltd. of Switzerland; and 0.5% Dow TERGITOL® TMN-3 non-ionic surfactant commercially available from Dow Chemical Company of Midland, Mich.). For Samples E1-E7, the binder material was a fluoropolymer/nitrile rubber blend (84.5 wt. % nitrile rubber polymer sold as TYLAC®68073 from Dow Reichhold of North Carolina; 15 wt. % NUVA® TTH U fluorocarbon resin; and 0.5% Dow TERGITOL® TMN-3 non-ionic surfactant).

Each of the fabric samples were non-woven, consolidated fabrics with a two-ply (two unitape), 0°/90° construction. The 45 layer fabric samples had total weights and TAD as shown in Table 3. The fiber content of each fabric was approximately 85%, with the balance of 15% being the identified non-wax-containing polymeric binder material. Each of the wax coated samples C2-C4, D2-D4, E2-E4 and E7 were coated with Shamrock S-400 N5 wax, which is an ethylene bis-stearamide wax, commercially available from Shamrock Technologies, Inc. The wax coating consisted of approximately 2% of the weight of each sample by weight of the fibers plus the matrix/binder and the wax. Each layer within these wax-coated samples was prepared by first weighing each layer of fabric, then coating each layer with wax by manually sprinkling an excess of the Shamrock S-400 N5 onto both surfaces of the layer, gently buffing the wax around the surfaces of the layer, removing the excess wax that did not adhere to the surfaces of the layer, and re-weighing the samples to determine weight pick-up. Additionally, each layer of Samples C2, C3, D2, D3, E2, E3 and E7 was processed by passing through a flat-bed laminator set at 220° F. to press/melt/fuse the wax into/onto the surfaces of the layer. Samples C1, D1, E1 and E6 were raw control samples with no topical wax coating and no processing conducted.

Samples C5, D5 and E5 were processed control samples that also had no topical wax coating but were processed through the flat-bed laminator at 220° F. The inclusion of raw control samples, coated but unprocessed samples, and processed control samples was done to determine whether any change in ballistic performance could be attributed to the wax, or if the processing also had an influence on the performance.

Each of the samples was tested for $V_{50}$ against 9 mm, 124 grain bullets following the standardized testing conditions of MIL-STD-662F. Articles of ballistic resistant armor can be designed and constructed so as to achieve a desired $V_{50}$ by adding or subtracting individual layers of ballistic resistant fabric. For the purpose of these experiments, the construction of the articles was standardized by stacking a sufficient number of fabric layers (45) such that the Total Areal Density of the article was approximately 1.01±0.02 psf. Table 3 summarizes the results.

TABLE 3

| Example | Sample | Weight (lbs.) | TAD (lb/ft$^2$) | Wax | Process | $V_{50}$ (ft/sec) |
|---|---|---|---|---|---|---|
| 17 | C1 | 1.532 (0.695 kg) | 0.98 (4.78 kg/m$^2$) | N/A | N/A | 1690 (515 m/sec) |
| 18 | C2 | 1.573 (0.714 kg) | 1.01 (4.93 kg/m$^2$) | Y | Y | 1804 (550 m/sec) |
| 19 | C3 | 1.570 (0.712 kg) | 1.00 (4.88 kg/m$^2$) | Y | Y | 1824 (556 m/sec) |
| 20 | C4 | 1.613 (0.732 kg) | 1.03 (5.03 kg/m$^2$) | Y | N/A | 1794 (547 m/sec) |
| 21 | C5 | 1.534 (0.696 kg) | 0.98 (4.78 kg/m$^2$) | N/A | Y | 1724 (525 msec) |
| 22 | D1 | 1.590 (0.721 kg) | 1.02 (4.98 kg/m$^2$) | N/A | N/A | 1693 (516 m/sec) |
| 23 | D2 | 1.600 (0.726 kg) | 1.02 (4.98 kg/m$^2$) | Y | Y | 1711 (522 m/sec) |
| 24 | D3 | 1.590 (0.721 kg) | 1.02 (4.98 kg/m$^2$) | Y | Y | 1743 (531 m/sec) |
| 25 | D4 | 1.598 (0.725 kg) | 1.02 (4.98 kg/m$^2$) | Y | N/A | 1742 (531 m/sec) |
| 26 | D5 | 1.545 (0.701 kg) | 0.99 (4.83 kg/m$^2$) | N/A | Y | 1648 (502 m/sec) |
| 27 | E1 | 1.544 (0.700 kg) | 0.99 (4.83 kg/m$^2$) | N/A | N/A | 1673 (510 m/sec) |
| 28 | E2 | 1.584 (0.719 kg) | 1.01 (4.93 kg/m$^2$) | Y | Y | 1779 (542 m/sec) |
| 29 | E3 | 1.580 (0.717 kg) | 1.01 (4.93 kg/m$^2$) | Y | Y | 1792 (546 m/sec) |
| 30 | E4 | 1.584 (0.719 kg) | 1.01 (4.93 kg/m$^2$) | Y | N/A | 1802 (549 m/sec) |
| 31 | E5 | 1.542 (0.699 kg) | 0.99 (4.83 kg/m$^2$) | N/A | Y | 1729 (527 m/sec) |
| 32 | E6 | 1.550 (0.703 kg) | 1.00 (4.88 kg/m$^2$) | N/A | N/A | 1710 (521 m/sec) |
| 33 | E7 | 1.600 (0.726 kg) | 1.00 (4.88 kg/m$^2$) | Y | Y | 1757 (536 m/sec) |

Very unexpectedly, a regression analysis of the above data finds that the presence of a wax coating actually raised the 9 mm bullet $V_{50}$ by approximately 80 ft/second (24 m/sec). Thus the materials of the invention desirably achieve both enhanced abrasion resistance and improved ballistic penetration resistance.

EXAMPLES 34-43

Another set of various fabric samples were then tested for ballistic performance as exemplified below. Each sample comprised 1000-denier TWARON® type 2000 aramid fibers which were coated with a polymeric binder material, and included forty-five 15"×15" fiber layers. For Samples F1-F5, the binder material was a fluorocarbon-modified, water-based acrylic polymer (84.5 wt. % acrylic copolymer sold as HYCAR® 26477, commercially available from Noveon, Inc. of Cleveland, Ohio; 15 wt. % NUVA® LB fluorocarbon resin, commercially available from Clariant International, Ltd. of Switzerland; and 0.5% Dow TERGITOL® TMN-3 non-ionic surfactant commercially available from Dow Chemical Company of Midland, Mich.). For Samples G1-G5, the binder material was a fluoropolymer/polyurethane blend (84.5 wt. % polyurethane polymer sold as SANCURE 20025, commercially available from Noveon, Inc. of Cleveland, Ohio; 15 wt. % NUVA® NT X490 fluorocarbon resin; and 0.5% Dow TERGITOL® TMN-3 non-ionic surfactant).

Each of the fabric samples were non-woven, consolidated fabrics with a two-ply (two unitape), 0°/90° construction. The 45 layer fabric samples had total weights and TAD as shown in Table 4. The fiber content of each fabric was approximately 85%, with the balance of 15% being the identified non-wax-containing polymeric binder material. Each of the wax coated samples F4 and G4 were coated with Shamrock S-232 N1 wax, which is a carnauba wax and polyethylene wax blend, commercially available from Shamrock Technologies, Inc, Newark, N.J. Each of the wax coated samples F5 and G5 were coated with Shamrock FluoroSlip 731MG N1 wax, which is a carnauba wax, polyethylene wax and polytetrafluoroethylene blend, commercially available from Shamrock Technologies, Inc, Newark, N.J. The wax coatings consisted of approximately 2% of the weight of each sample by weight of the fibers plus the matrix/binder and the wax. Each layer within these wax-coated samples was weighed and then coated with wax by manually sprinkling an excess of the powdered wax onto both surfaces of the layer, gently buffing the wax around the surfaces of the layer, removing the excess wax that did not adhere to the surfaces of the layer, and re-weighing the samples to determine weight pick-up. Additionally, each layer of Samples F4, F5, G4 and G5 was processed by passing through a flat-bed laminator set at 220° F. to press/melt/fuse the wax into/onto the surfaces of the layer. Samples F1, F2, G1 and G2 were raw control samples with no topical wax coating and no processing conducted. Samples F3 and G3 were processed control samples, that also had no topical wax coating but were processed through the flat-bed laminator at 220° F. The inclusion of both raw control samples and processed control samples was done to determine whether any change in ballistic performance could be attributed to the wax, or if the processing also had an influence on the performance.

Each of the samples was tested for $V_{50}$ against 44 Magnum bullets following the standardized testing conditions of MIL-STD-662F. Articles of ballistic resistant armor can be designed and constructed so as to achieve a desired $V_{50}$ by adding or subtracting individual layers of ballistic resistant fabric. For the purpose of these experiments, the construction of the articles was standardized by stacking a sufficient number of fabric layers (45) such that the Total Areal Density of the article was approximately 1.01±0.02 psf. Table 4 summarizes the results.

TABLE 4

| Example | Sample | Weight (lbs.) | TAD (lb/ft$^2$) | Wax | Process | $V_{50}$ (ft/sec) |
|---|---|---|---|---|---|---|
| 34 | F1 | 1.573 (0.714 kg) | 1.01 (4.93 kg/m$^2$) | N/A | N/A | 1550 (472 m/sec) |
| 35 | F2 | 1.545 (0.701 kg) | 0.99 (4.83 kg/m$^2$) | N/A | N/A | 1630 (496 m/sec) |
| 36 | F3 | 1.590 (0.721 kg) | 1.02 (4.98 kg/m$^2$) | N/A | Y | 1597 (487 m/sec) |
| 37 | F4 | 1.613 (0.732 kg) | 1.03 (5.03 kg/m$^2$) | S-232 N1 | Y | 1709 (521 m/sec) |
| 38 | F5 | 1.590 (0.721 kg) | 1.02 (4.98 kg/m$^2$) | 731MG | Y | 1669 (508 m/sec) |
| 39 | G1 | 1.532 (0.695 kg) | 0.98 (4.78 kg/m$^2$) | N/A | N/A | 1538 (468 m/sec) |
| 40 | G2 | 1.598 (0.725 kg) | 1.02 (4.98 kg/m$^2$) | N/A | N/A | 1502 (458 m/sec) |
| 41 | G3 | 1.534 (0.696 kg) | 0.98 (4.78 kg/m$^2$) | N/A | Y | 1581 (482 m/sec) |
| 42 | G4 | 1.570 (0.712 kg) | 1.00 (4.88 kg/m$^2$) | S-232 N1 | Y | 1629 (496 m/sec) |
| 43 | G5 | 1.600 (0.726 kg) | 1.02 (4.98 kg/m$^2$) | 731MG | Y | 1648 (502 m/sec) |

Following the pattern observed in Examples 17-33, a regression analysis of the above data for Examples 34-43 finds that the presence of a wax coating unexpectedly raised the 44 Magnum $V_{50}$ by approximately 74 ft/second (23 m/sec). Thus the materials of the invention desirably achieve both enhanced abrasion resistance and improved ballistic penetration resistance.

While the present invention has been particularly shown and described with reference to preferred embodiments, it will be readily appreciated by those of ordinary skill in the art that various changes and modifications may be made without departing from the spirit and scope of the invention. It is intended that the claims be interpreted to cover the disclosed embodiment, those alternatives which have been discussed above and all equivalents thereto.

What is claimed is:

1. A ballistic resistant composite comprising at least one fibrous substrate having a multilayer coating thereon, wherein said fibrous substrate comprises one or more fibers having a tenacity of about 7 g/denier or more and a tensile modulus of about 150 g/denier or more; said multilayer coating comprising a layer of a polymeric binder material on a surface of said one or more fibers, and a layer of a wax on the polymeric binder material layer.

2. The composite of claim 1 wherein said wax comprises beeswax, Chinese wax, shellac wax, spermaceti wax, wool wax, bayberry wax, candelilla wax, carnauba wax, castor wax, esparto wax, Japan wax, jojoba oil wax, ouricury wax, rice bran wax, soy wax, ceresin wax, montan wax, ozocerite, peat wax, paraffin wax, a microcrystalline wax, a polyethylene wax, polypropylene wax, an alpha-olefin wax, a Fischer-Tropsch wax, a stearamide wax, an esterified amide wax, a saponified amide wax, or combinations thereof.

3. The composite of claim 1 wherein said layer of wax comprises a blend of a wax with a fluorine-containing polymer.

4. The composite of claim 1 wherein the polymeric binder material comprises a polyurethane polymer, a polyether polymer, a polyester polymer, a polycarbonate polymer, a polyacetal polymer, a polyamide polymer, a polybutylene polymer, an ethylene-vinyl acetate copolymer, an ethylene-vinyl alcohol copolymer, an ionomer, a styrene-isoprene copolymer, a styrene-butadiene copolymer, a styrene-ethylene/butylene copolymer, a styrene-ethylene/propylene copolymer, a polymethyl pentene polymer, a hydrogenated styrene-ethylene/butylene copolymer, a maleic anhydride functionalized styrene-ethylene/butylene copolymer, a carboxylic acid functionalized styrene-ethylene/butylene copolymer, an acrylonitrile polymer, an acrylonitrile butadiene styrene copolymer, a polypropylene polymer, a polypropylene copolymer, an epoxy polymer, a novolac polymer, a phenolic polymer, a vinyl ester polymer, a nitrile rubber polymer, a natural rubber polymer, a cellulose acetate butyrate polymer, a polyvinyl butyral polymer, an acrylic polymer, an acrylic copolymer, an acrylic copolymer incorporating non-acrylic monomers or combinations thereof.

5. The composite of claim 1 wherein said fibrous substrate comprises a fabric formed from a plurality of fibers.

6. The composite of claim 5 wherein said fabric comprises a non-woven fabric.

7. The composite of claim 5 wherein said fabric has two surfaces and the wax coats one or both of said fabric surfaces.

8. The composite of claim 1 wherein said wax comprises a low viscosity wax.

9. The composite of claim 1 wherein said wax comprises from about 0.01% to about 5.0% by weight of said composite.

10. The composite of claim 1 wherein said polymeric binder material comprises from about 1% to about 50% by weight of said composite.

11. An article comprising the composite of claim 1.

12. The article of claim 11 which comprises flexible body armor.

13. A method of forming a ballistic resistant composite, comprising:

i) providing at least one coated fibrous substrate having a surface; wherein said at least one fibrous substrate comprises one or more fibers having a tenacity of about 7 g/denier or more and a tensile modulus of about 150 g/denier or more; the surfaces of each of said fibers being substantially coated with a polymeric binder material; and ii) applying a wax onto at least a portion of said at least one coated fibrous substrate.

14. The method of claim 13 wherein said wax comprises beeswax, Chinese wax, shellac wax, spermaceti wax, wool wax, bayberry wax, candelilla wax, carnauba wax, castor wax, esparto wax, Japan wax, jojoba oil wax, ouricury wax, rice bran wax, soy wax, ceresin wax, montan wax, ozocerite, peat wax, paraffin wax, a microcrystalline wax, a polyethylene wax, polypropylene wax, an alpha-olefin wax, a Fischer-Tropsch wax, a stearamide wax, an esterified amide wax, a saponified amide wax, or combinations thereof.

15. The method of claim 13 wherein said layer of wax comprises a blend of a wax with a fluorine-containing polymer.

16. The method of claim 13 wherein said fibrous substrate comprises a fabric formed from a plurality of fibers.

17. The method of claim 16 wherein said fabric has two surfaces and the wax coats one or both of said fabric surfaces.

18. The method of claim 16 wherein said fabric comprises a non-woven fabric.

19. The method of claim 16 wherein said wax comprises a low viscosity wax.

20. The method of claim 13 further comprising forming an article from said composite.

* * * * *